US007458843B2

(12) United States Patent
Xie

(10) Patent No.: US 7,458,843 B2
(45) Date of Patent: Dec. 2, 2008

(54) CONNECTOR STRUCTURE

(75) Inventor: Qui-Da Xie, Hukou Township, Hsinchu County (TW)

(73) Assignee: Singatron Enterprise Co., Ltd. (TW)

( * ) Notice: Subject to any disclaimer, the term of this patent is extended or adjusted under 35 U.S.C. 154(b) by 0 days.

(21) Appl. No.: 11/783,264

(22) Filed: Apr. 6, 2007

(65) Prior Publication Data

US 2008/0248686 A1 Oct. 9, 2008

(51) Int. Cl.
*H01R 3/00* (2006.01)

(52) U.S. Cl. ..... 439/490; 439/79

(58) Field of Classification Search ..... 439/490, 439/595, 79, 59

See application file for complete search history.

(56) References Cited

U.S. PATENT DOCUMENTS 6,183,270 B1 * 2/2001 Huang et al. ..... 439/79
6,688,908 B2 * 2/2004 Wallace ..... 439/490

* cited by examiner

*Primary Examiner*—Neil Abrams
*Assistant Examiner*—Phuong Nguyen
(74) *Attorney, Agent, or Firm*—Troxell Law Office, PLLC

(57) ABSTRACT

A connector structure is constituted by a body, an illumination element, and a locking seat, wherein the body is extended with a cover, and an interior of the body is provided with a first tunnel having a contact terminal and conduction terminal, as well as a second tunnel having the illumination element and the locking seat. By installing the illumination element on the locking seat, and by transversal movement of the locking seat in a locking slot of the body, the illumination element can be conveniently assembled with the body, and the locking seat can be stably connected with the body without easily dropping out.

3 Claims, 7 Drawing Sheets

CONNECTOR STRUCTURE

BACKGROUND OF THE INVENTION (a) Field of the Invention

The present invention relates to a connector structure, and more particularly to a connector structure which is provided with a locking seat that is moved transversally to be joined with a body.

(b) Description of the Prior Art

Referring to FIG. 1 and FIG. 2, a connector A is provided with a body A1, an interior of which is transfixed with a tunnel A2 that is installed with a conduction terminal A3, a contact terminal A4, and an illumination element A5, and a lower part of which is extended with a locking seat A6 that is joined with the illumination element A5 and is locked at the body A1. When the illumination element A5 is to be disposed in the tunnel A2, the locking seat A6 should be installed on the body A1 simultaneously. However, to install the illumination element A5 and the locking seat A6 at a same time is indeed a very inconvenient method of assembly, and as the elements are easy to drop out, they cannot be effectively and stably installed.

Accordingly, how to eliminate the aforementioned problems is a technical issue to be solved by the present inventor.

SUMMARY OF THE INVENTION

The primary object of present invention is to provide a connector structure, wherein a locking seat is moved transversally to be joined with a body, and is corresponding to an illumination element, so as to conveniently and stably install the illumination element without dropping out.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
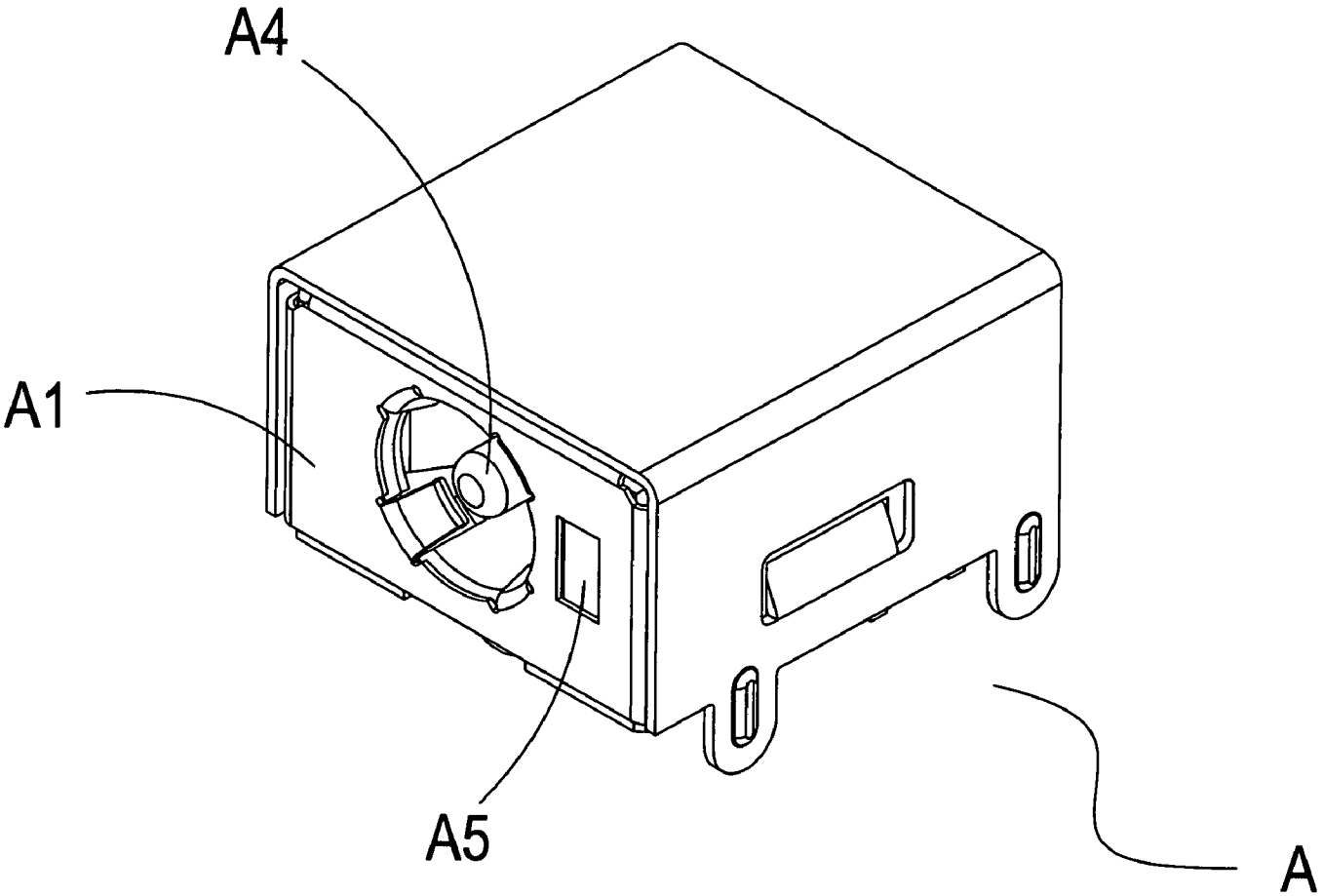
FIG. 1 Prior Art
FIG. 1 shows a perspective view of a conventional connector.
Figure 2:
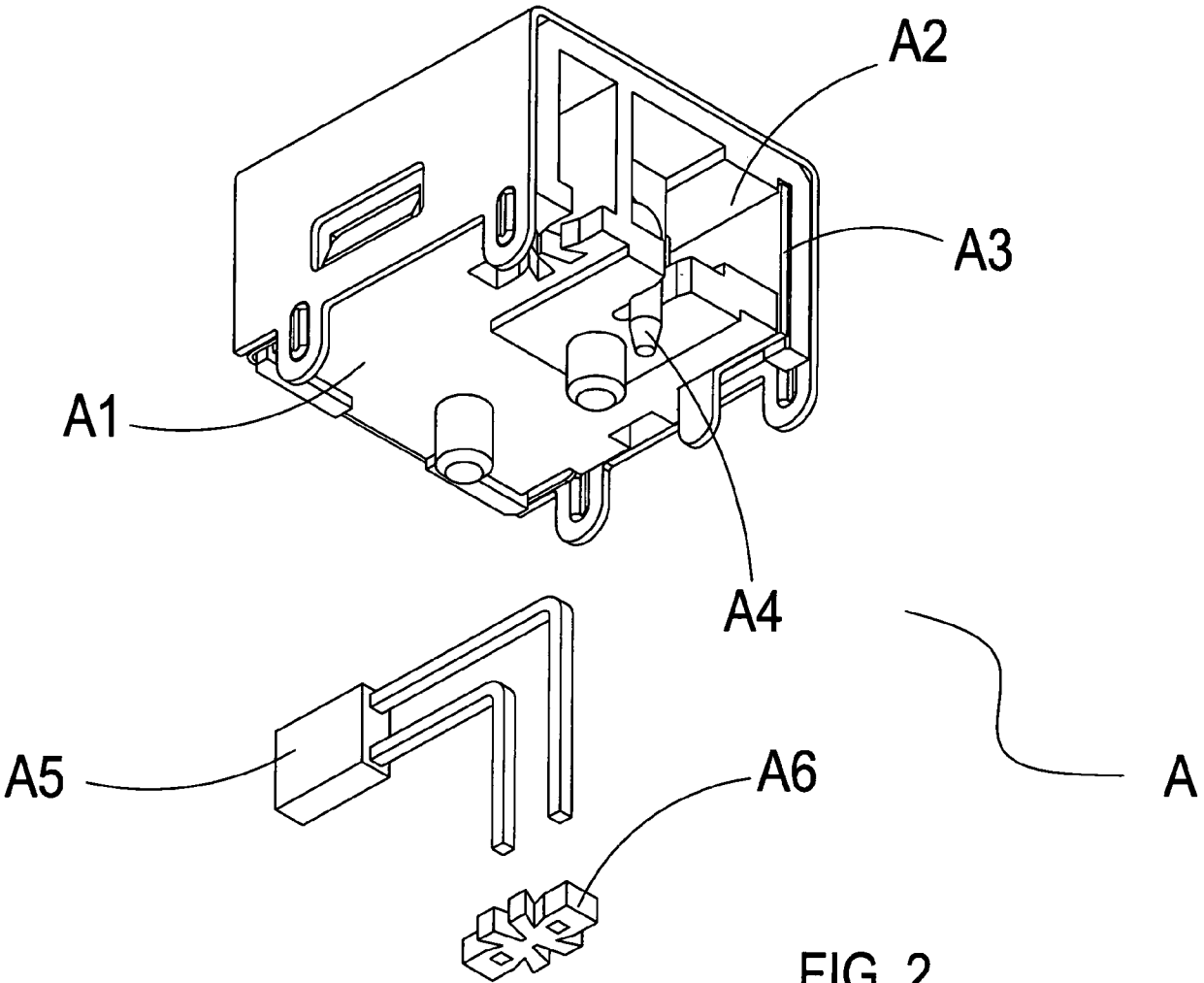
FIG. 2 Prior Art
FIG. 2 shows an exploded view of a conventional connector.
Figure 3:
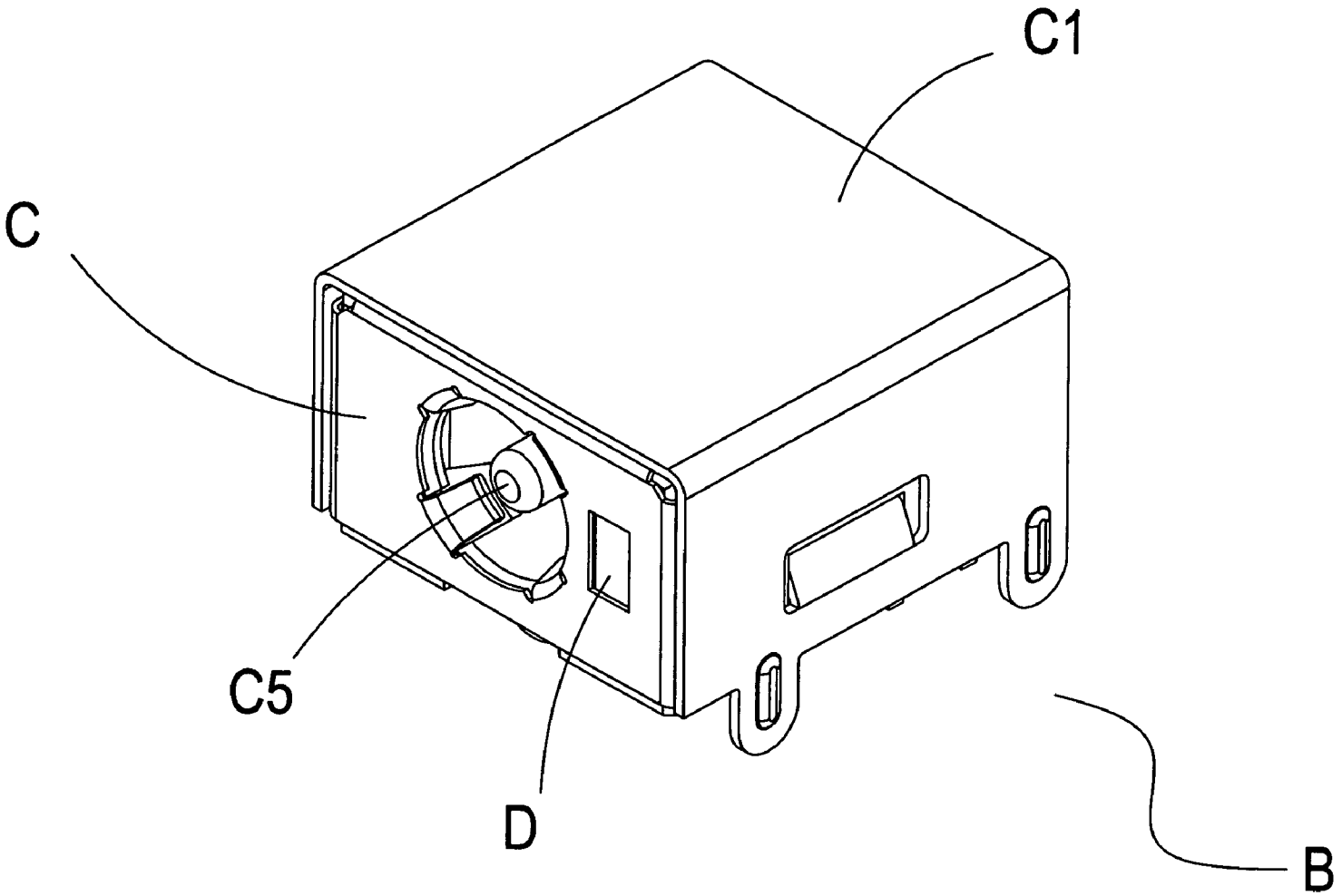
FIG. 3 shows a perspective view of the present invention.
Figure 4:
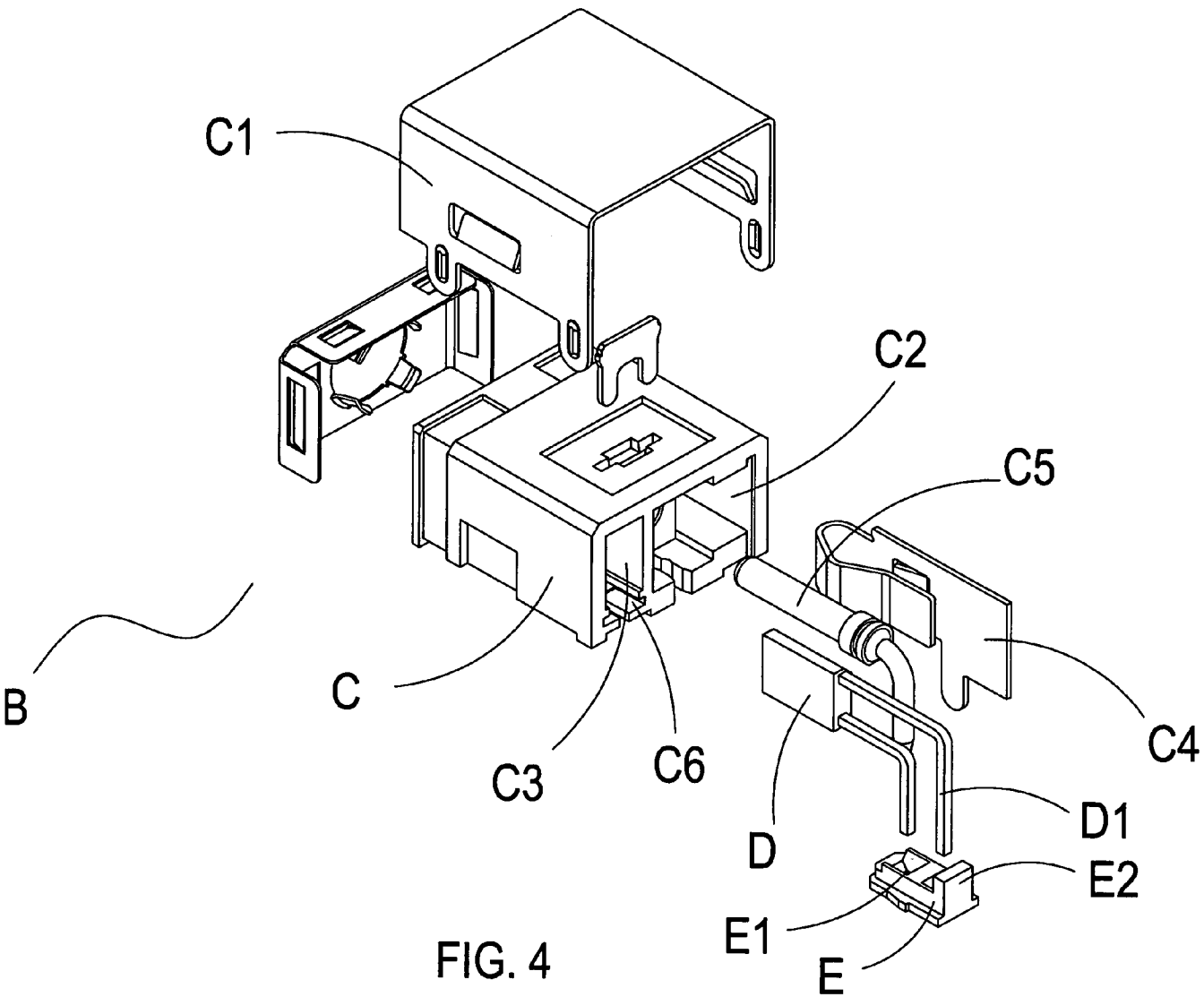
FIG. 4 shows an exploded view of the present invention.

Referring to FIG. 3 and FIG. 4, a connector B of the present invention comprises a body C, an illumination element D, and a locking seat E, wherein the body C is extended with a cover C1, and an interior of the body C is transfixed with a first tunnel C2 and a second tunnel C3. An interior of the first tunnel C2 is provided with a conduction terminal C4 and a contact terminal C5, and an interior of the second tunnel C3 is provided with the illumination element D. In addition, a locking slot C6 of the second tunnel C3 is extended with the locking seat E which can be moved transversally. Pins D1 of the illumination element D are transfixed into through-holes E1 of the locking seat E, and the locking seat E is extended with a protruded member E2 to prevent from inserting by mistake. By installing the illumination element D onto the locking seat E, and by transversal movement of the locking seat E in the locking slot C6, the illumination element D can be assembled conveniently and stably, without easily dropping out.

Figure 5:
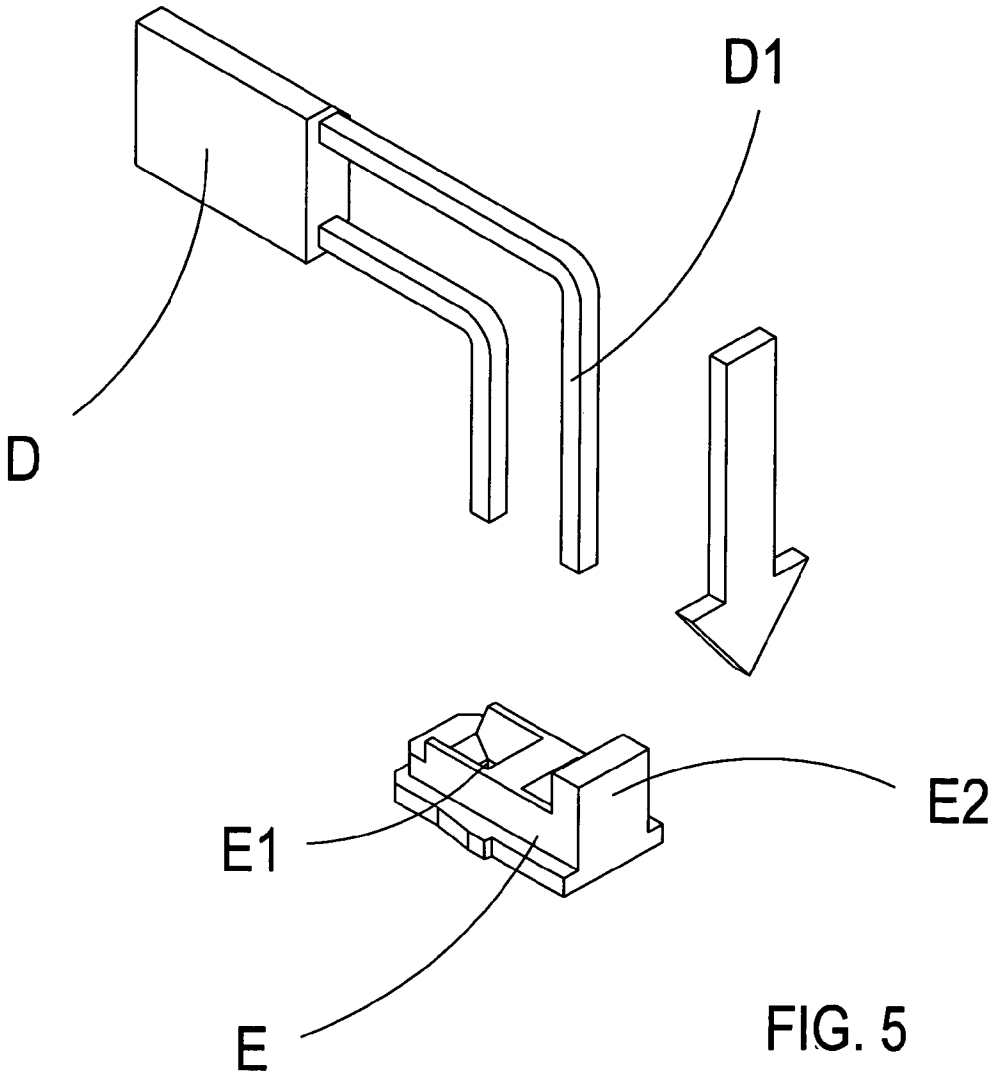
FIG. 5 shows a schematic view of an embodiment of the present invention.
Figure 6:
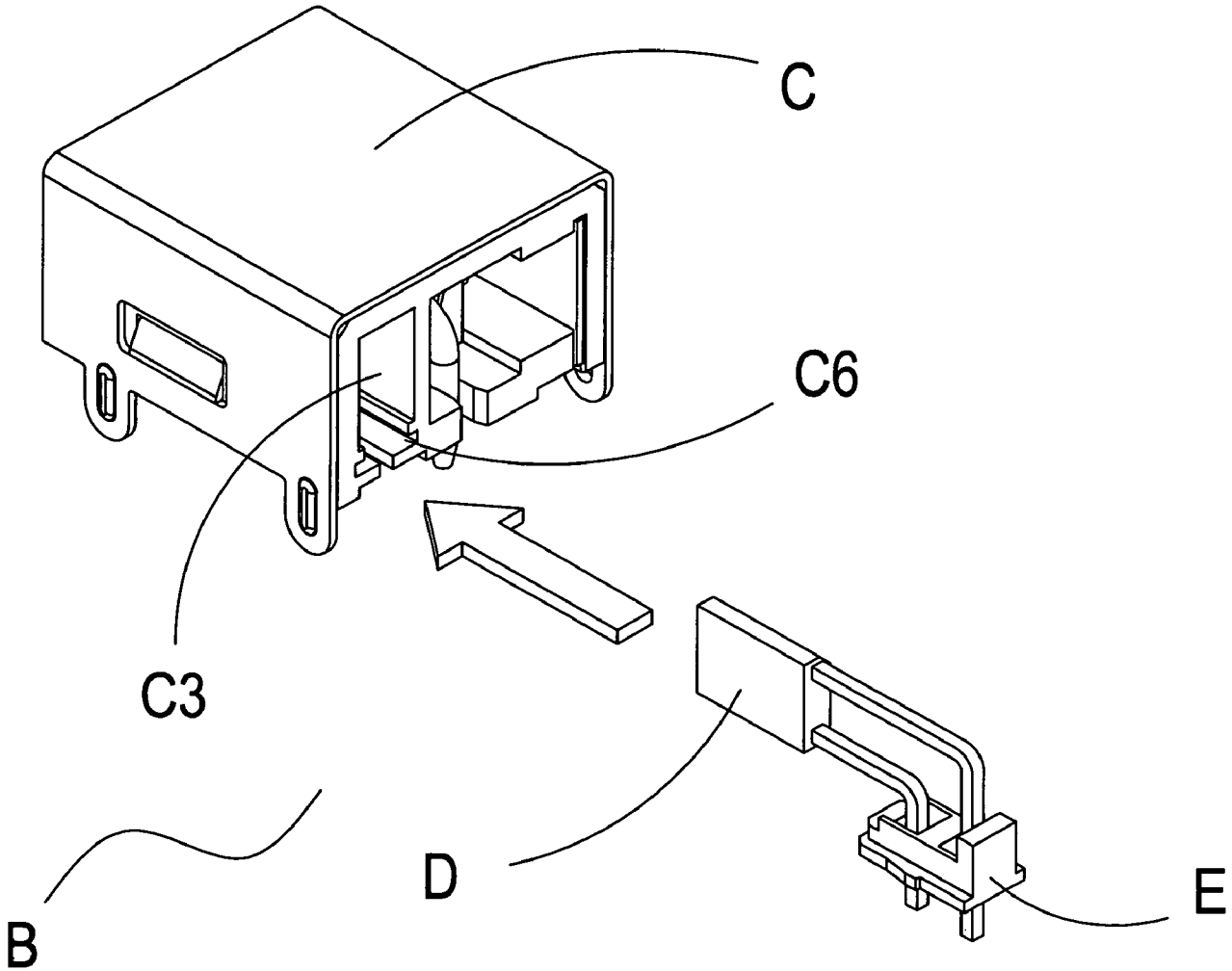
FIG. 6 shows a second schematic view of an embodiment of the present invention.
Figure 7:
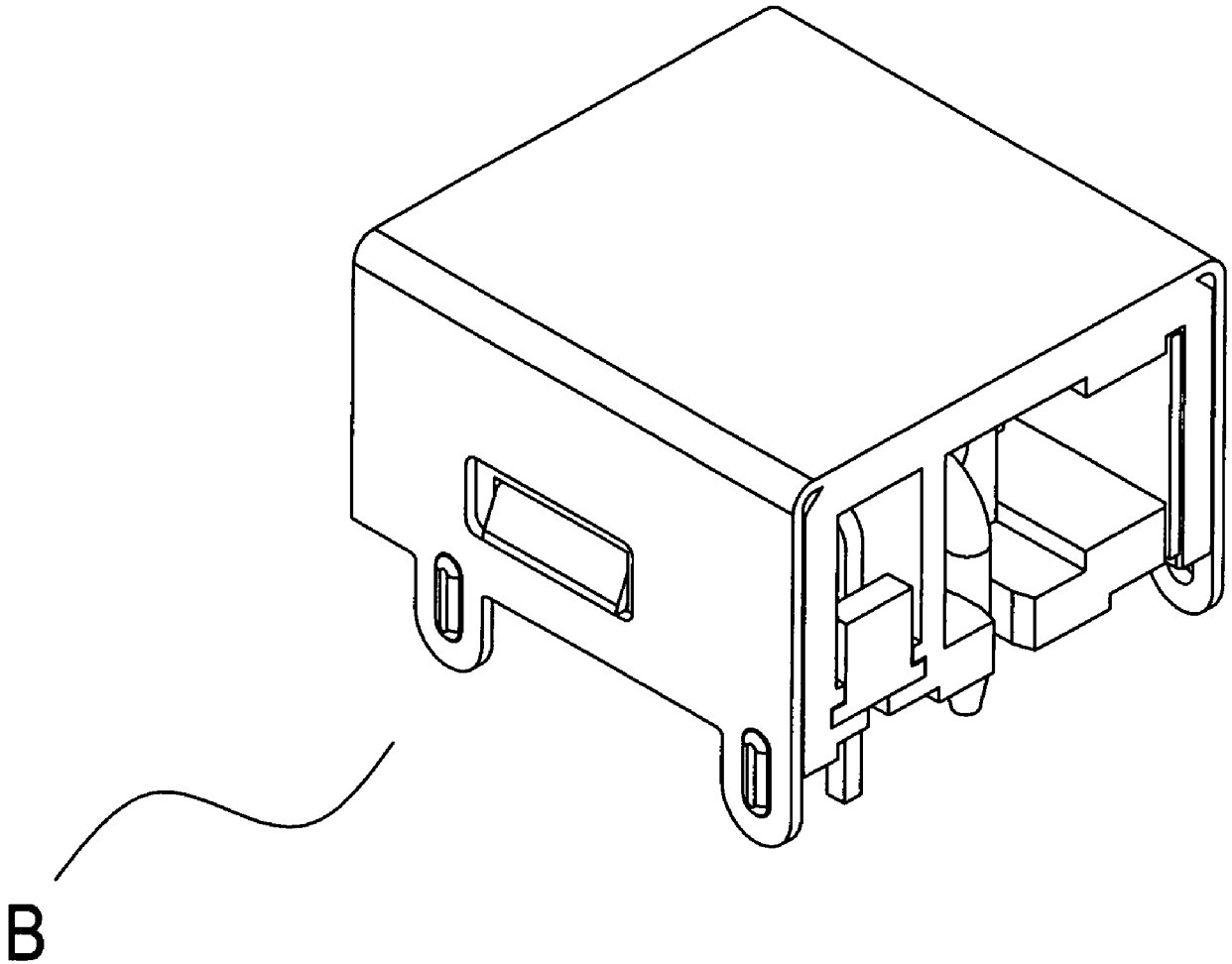
FIG. 7 shows a third schematic view of an embodiment of the present invention.

Referring to FIGS. 5 to 7, the interior of the body C of the connector B is provided with the second tunnel C3, the interior of which is extended with the locking slot C6. When the illumination element D is to be installed in the second tunnel C3 for being energized to illuminate, the illumination element D is joined with the locking seat E, and discrimination for preventing from insertion by mistake is carried out by the protruded member E2 of the locking seat E, enabling the pins D1 of the illumination element D to be transfixed into the through-holes E1 of the locking seat E. Furthermore, the locking seat E, which is transfixed with the illumination element D, is moved transversally to the second tunnel C3 of the body C, and is stably connected with the locking slot C6, so as to install the illumination element D into the second tunnel C3; wherein, the locking seat E is assembled correspondingly with the illumination element D, and is moved transversally to the locking slot C6, thereby allowing the illumination element D to be conveniently and stably assembled, without easily dropping out.

To further manifest the advancement and practicability of the present invention, the present invention is compared with a conventional connector as follow.

Shortcomings of a Conventional Connector

1. In installing the illumination element, the locking seat should be correspondingly joined at a same time.
2. It is inconvenient to assemble the illumination element.
3. The illumination element cannot be effectively and stably installed.

Advantages of the Present Invention

1. In installing the illumination element, it can correspond to the locking slot by the transversal movement of the locking seat.
2. It is convenient to assemble the illumination element.
3. The illumination element can be stably installed without easily dropping out.
4. It is provided with the advancement and practicability.
5. It can improve the industrial competitiveness.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A connector structure being constituted by a body, an illumination element, and a locking seat, wherein an interior of the body is transfixed with a first tunnel and a second tunnel, an interior of the first tunnel is provided with a conduction terminal and a contact terminal, and an interior of the second tunnel is provided with the illumination element; the illumination element partially extending through the locking seat which is moved transversally and is latched into a locking slot of the second tunnel; the locking seat corresponding to the illumination element, and being extendedly installed into the locking slot, thereby enabling the illumination element to be assembled conveniently and stably, without easily dropping out, wherein an end of the locking seat is extended with a protruded member to prevent from insertion by mistake, when the locking seat is installed in the locking slot.

2. The connector structure according to claim 1, wherein the body is provided with a cover to cover the body effectively.

3. The connector structure according to claim 1, wherein the locking seat is further provided with a plurality of through-holes for transfixing with pins of the illumination element.

* * * * *